United States Patent [19]

Morishita

[11] Patent Number: 4,627,117

[45] Date of Patent: Dec. 9, 1986

[54] PAPER COVER FOR LAVATORY SEAT

[76] Inventor: Kanji Morishita, 652, Higashihama Minamimachi, Fushimi-ku, Kyoto, Japan

[21] Appl. No.: 825,769

[22] Filed: Feb. 3, 1986

Related U.S. Application Data

[63] Continuation of Ser. No. 571,532, Jan. 17, 1984, abandoned.

[30] Foreign Application Priority Data

Jun. 13, 1983 [JP] Japan ..... 58-92276[U]

[51] Int. Cl.[4] ..... A47R 13/22

[52] U.S. Cl. ..... 4/247; 206/390

[58] Field of Search ..... 4/242, 243, 247; 206/390, 820, 824; 40/20; 2/48

[56] References Cited

U.S. PATENT DOCUMENTS

| | | | |
|---|---|---|---|
| 453,003 | 5/1891 | Hicks | 206/390 X |
| 3,225,918 | 12/1965 | Mines | 206/390 |
| 3,613,142 | 10/1971 | Chaney | 206/390 X |

FOREIGN PATENT DOCUMENTS

| | | | |
|---|---|---|---|
| 1518763 | 2/1968 | France | 206/390 |
| 50007 | 1/1932 | Norway | 4/247 |
| 50932 | 1/1910 | Switzerland | 4/247 |
| 16868 | of 1892 | United Kingdom | 4/237 |
| 426244 | 3/1935 | United Kingdom | 206/390 |

*Primary Examiner*—Charles E. Phillips

[57] ABSTRACT

A paper cover for a lavatory seat of a toilet bowl is proposed which is a paper web in a roll form formed with a plurality of perforations at regular intervals. Every second perforations are discontinuous or are provided with a cut at at least one side. The sheet of paper torn off the roll is of a sufficient size to cover the bow-shaped portion of the lavatory seat.

2 Claims, 8 Drawing Figures

PAPER COVER FOR LAVATORY SEAT

This application is a continuation of now abandoned application Ser. No. 571,532, filed Jan. 17, 1984.

The present invention relates to a paper cover adapted to be put on a lavatory seat of a toilet bowl.

The toilet bowl with a lavatory seat is installed at public facilities such as hotels, department stores and supermarkets. Direct contact of the body on the lavatory seat of such a toilet bowl for use by unspecified persons gives the user unpleasantness. In addition, it is unsanitary. For toilet bowls in an ordinary home, the lavatory seat is often provided with a throwaway cover made of cloth. But, for toilet bowls for use by unspecified persons, the use of such a cover is not suitable. So, the lavatory seat is not covered.

An object of the present invention is to provide a paper cover for a lavatory seat which enables a toilet bowl for use by unspecified persons to be used pleasantly.

Other objects and features of the present invention will become apparent from the following description taken with reference to the accompanying drawings, in which.

Figure 1:
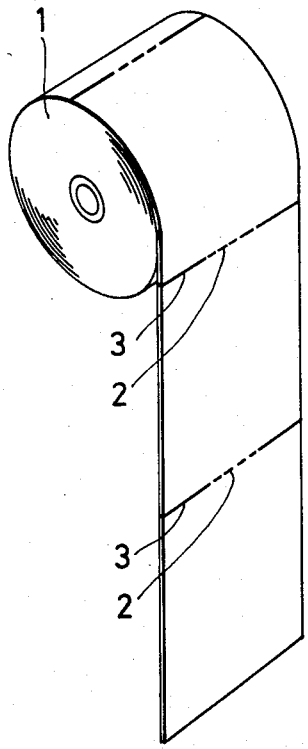
FIG. 1 is a perspective view of the first embodiment of the present invention.

Referring to FIG. 1, a roll of paper 1 is formed with a plurality of transverse perforations 2 at regular intervals. At either end of each perforation, a cut 3 is formed. The interval between the perforations 2 is substantially half the length L of a lavatory seat A of a toilet bowl. The paper web should be considerably wider than the width of a bowl-shaped member B of the lavatory seat.

Each sheet of paper 4 is obtained by unwinding the web of paper from the roll 1 and tearing off the paper along every second perforation 2. The sheet of paper thus obtained is of a size sufficient to cover the whole part of the bowl-shaped member B of the lavatory seat.

Figure 2:
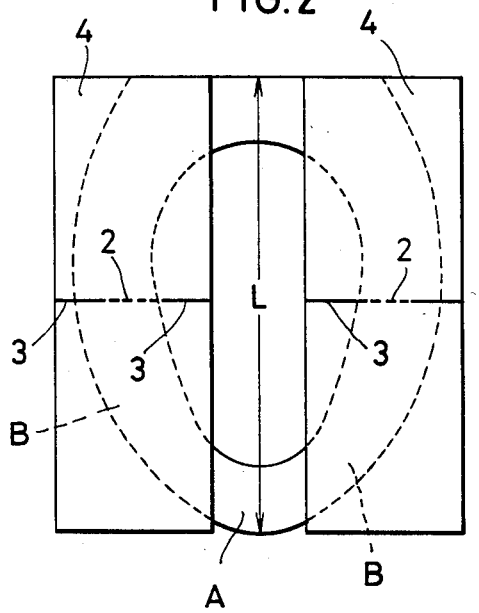
FIGS. 2 and 3 are plan views thereof mounted on a lavatory seat.
Figure 3:
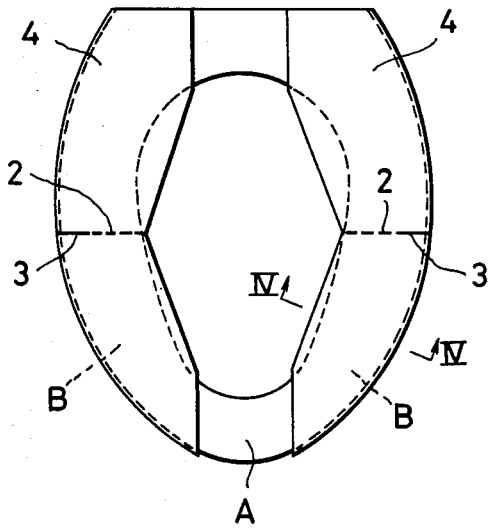
Figure 4:
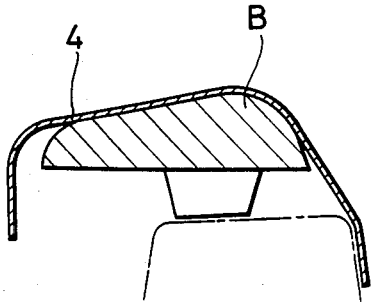
FIG. 4 is an enlarged sectional view taken along the line IV—IV of FIG. 3.
Figure 5:
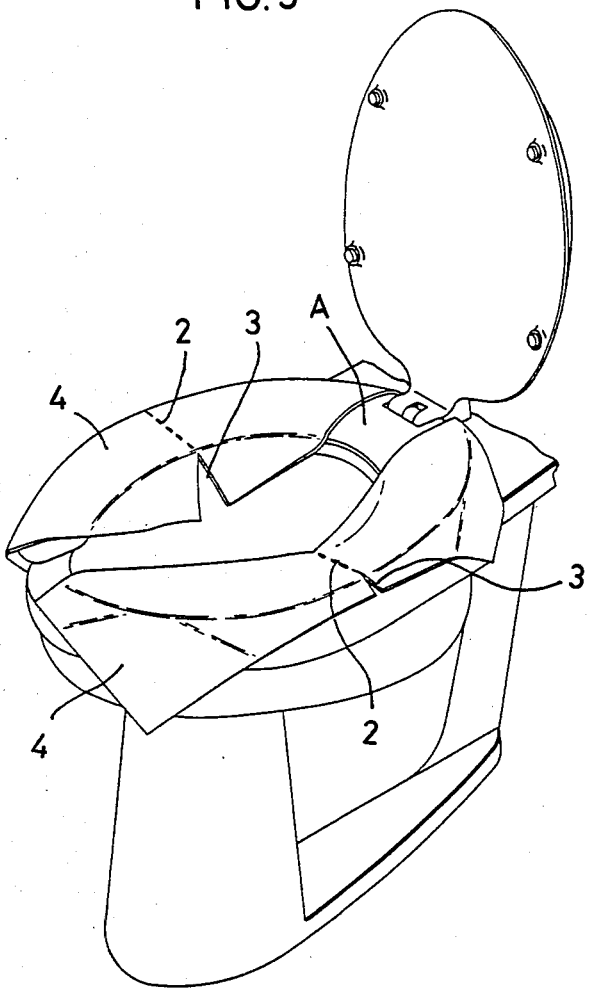
FIG. 5 is a perspective view showing how the first embodiment is used.

In use, a sheet of paper 4 is mounted on each bow-shaped member of the lavatory seat as shown in FIG. 2. Since there is a pair of the cuts 3 at the middle of the length of the sheet of paper and the sheet is sufficiently wider than the bowl-shaped member, the sheet of paper 4 hangs down along the side edges of the lavatory sheet. (FIGS. 3 and 5) Therefore, the paper 4 does not give any hindrance to defecation and urination. The paper prevents a direct contact of the body of the user with the lavatory seat and allows the user to relieve himself without feeling discomfort.

Although in the first embodiment the cut is formed at either side of the web of paper, it may be formed at least at one side.

Figure 6:
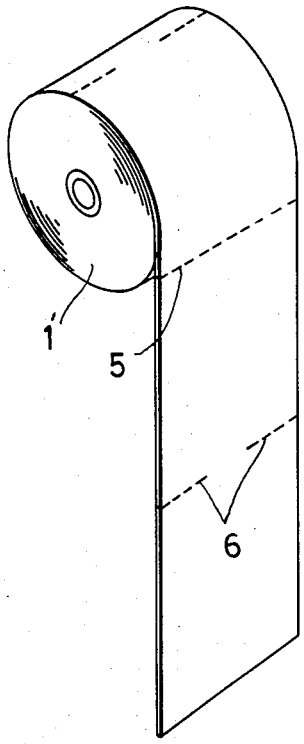
FIG. 6 is a perspective view of the second embodiment.
Figure 7:
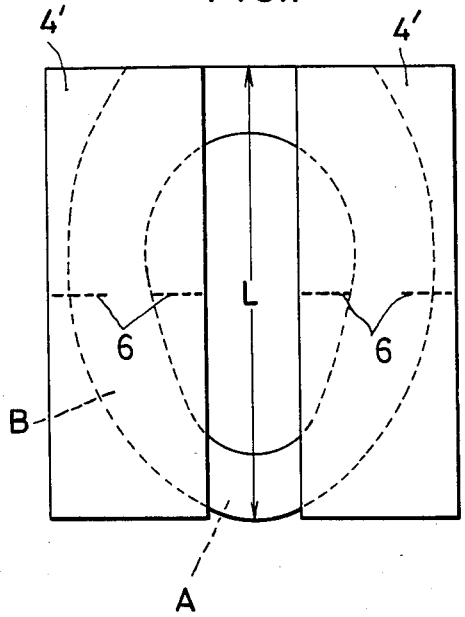
FIG. 7 is a plan view thereof mounted on a lavatory seat.

Referring to FIGS. 6 and 7, the web of paper is formed with a continuous transverse perforation and then a discontinuous transverse perforation at a longitudinal interval therefrom, the perforations alternating in the longitudinal direction. In use, the web of paper is torn off along the continuous perforation and one sheet is mounted on each bowl-shaped member of the lavatory seat as in FIG. 7. When the user sits on the sheets on the lavatory seat, the sheets will be torn under the weight of the user along the discontinuous perforation 6 and hang down along the side edges of each bowl-shaped member.

Figure 8:
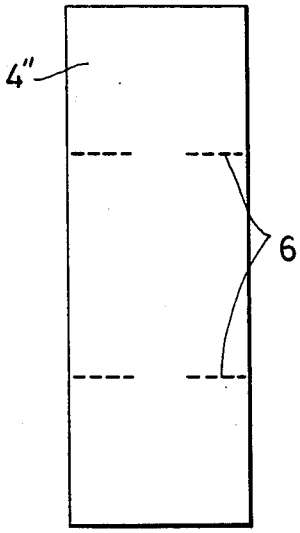
FIG. 8 is a plan view of the third embodiment.

Although in the second embodiment continuous perforations and discontinuous perforations are provided alternately, all of the perforations may be continuous. In the alternative, the discontinuous perforations may extend from one side of the paper to only midway of the width of the paper. Further, in the alternative, the sheet of paper may be formed with two discontinuous perforations between the continuous perforations as shown in FIG. 8.

The material of the paper is not particularly limited. But, the paper should preferably be creped and made of a material suitable for use in a flush toilet.

Although in the preferred embodiments the sheets of paper are adapted to be peeled off a web of paper in a roll form 1, they may be precut into a suitable size and stacked one upon another. In this case, the perforations for tearing off the sheet of paper can be omitted.

What are claimed are:

1. A roll of paper covers for a toilet bowl seat which seat has laterally spaced bowl-shaped side portions, said roll comprising a web of a plurality of lengths of paper at least as long as the front to back dimension of a bowl-shaped side portion and having a width greater than the width of the bowl-shaped side portion, said lengths of paper being defined by continuous transverse lines of perforations, each length of paper having at least one linear line of perforations extending inwardly from the opposite side edges substantially perpendicular thereto and at a position intermediate the ends of said lengths of paper, said line of perforations terminating short of the middle portion of each length of paper leaving the middle portion of each length of paper unperforated, the distance across said middle portion being sufficient to make the paper strong enough to remain untorn under a force substantially in the longitudinal direction of said web and which is sufficient to tear the paper along said continuous transverse lines of perforations.

2. A roll of paper covers as claimed in claim 1 in which there are perforations along only two aligned lines midway between the ends of each length of paper.

* * * * *